US006802671B1

(12) United States Patent
Badie et al.

(10) Patent No.: US 6,802,671 B1
(45) Date of Patent: Oct. 12, 2004

(54) INSTALLATION FOR VERY LONG TERM STORAGE OF HEAT-GENERATING PRODUCTS SUCH AS NUCLEAR WASTE

(75) Inventors: Michel Badie, La Ville du Bois (FR); Daniel Iracane, Palaiseau (FR); Alain Le Duigou, Paris (FR); Jacques Peulve, Orsay (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/937,494

(22) PCT Filed: Mar. 23, 2000

(86) PCT No.: PCT/FR00/00735

§ 371 (c)(1),
(2), (4) Date: Sep. 26, 2001

(87) PCT Pub. No.: WO00/60609

PCT Pub. Date: Oct. 12, 2000

(30) Foreign Application Priority Data

Mar. 30, 1999 (FR) ..... 99 03950

(51) Int. Cl.[7] ..... G21F 9/24

(52) U.S. Cl. ..... 405/129.55; 405/129.45; 588/900; 376/272

(58) Field of Search ..... 588/16, 17, 250; 405/129.55, 129.1, 129.45; 376/272, 273; 165/46, 169, 104, 28, 45

(56) References Cited

U.S. PATENT DOCUMENTS

| | | | | | |
|---|---|---|---|---|---|
| 3,319,202 | A | * | 5/1967 | Lockie | 165/128 |
| 3,335,789 | A | * | 8/1967 | Raskin | 165/169 |
| 3,404,722 | A | * | 10/1968 | Bloore | 976/DIG. 381 |
| 3,472,314 | A | * | 10/1969 | Balch | 165/136 |
| 3,910,347 | A | * | 10/1975 | Woebcke | 165/169 |
| 4,040,480 | A | | 8/1977 | Richards | |
| 4,147,938 | A | * | 4/1979 | Heckman et al. | 376/272 |
| 4,213,498 | A | * | 7/1980 | Vandenbossche | 165/169 |
| 4,672,213 | A | | 6/1987 | Stoll et al. | |
| 4,894,550 | A | * | 1/1990 | Baatz et al. | 376/272 |
| 5,314,264 | A | * | 5/1994 | Danko et al. | 405/129.35 |
| 5,564,498 | A | | 10/1996 | Bochard | |
| 6,008,428 | A | * | 12/1999 | Georgii | 588/16 |

FOREIGN PATENT DOCUMENTS

| | | | |
|---|---|---|---|
| DE | 223 562 | | 6/1985 |
| EP | 0 143 398 | | 6/1985 |
| EP | 0 702 374 | | 3/1996 |
| FR | 2-160-329 | | 6/1973 |
| JP | 60-33097 | * | 2/1985 |
| JP | 5-273393 | | 10/1993 |

OTHER PUBLICATIONS

Translation of JP 60–033097.*
Patent Abstracts of Japan: Concrete–made Cask, appl. No. 06192755, Jul. 1994.
Patent Abstracts of Japan: Spent Fuel Assembly Container Vessel. appl. No. 07001326, Jan. 1995.
Database WPI, Derwent Publ. Ltd., XP–002118314, High Temperature Vessel Skirt Heat Pipe Adjacent Joint Section reduce Thermal Stress, Aug. 1984.
Database WPI, Derwent Publ. Ltd., XP–002118315,Radioactive waste Disposable Facility Hole Ground Filled so Waste can Bury Heat Pipe Adjacent Waste Heat Exchange, Feb. 1985. Abstract of JP 60033097.

* cited by examiner

*Primary Examiner*—John Kreck
(74) *Attorney, Agent, or Firm*—Pearne & Gordon LLP

(57) ABSTRACT

A very long term storage installation for calorific products such as nuclear waste, comprises at least one closed cavity (10), in which at least one product confinement container is housed (14). To evacuate the heat released by the stored products, each container (14) is surrounded by a jacket (26) associated with a thermosiphon (24) whose cold source is formed of an air condenser provided above a slab (20) sealing the top part of the cavity. The jacket (26) is preferably interchangeable and tightly surrounds the container (14).

14 Claims, 4 Drawing Sheets

INSTALLATION FOR VERY LONG TERM STORAGE OF HEAT-GENERATING PRODUCTS SUCH AS NUCLEAR WASTE

FIELD OF THE INVENTION

The invention concerns an installation intended to ensure the storage over the very long term of calorific products likely to release large quantities of heat which may decrease in time.

The term "storage" designates the reversible storage of packaged products, accompanied by evacuation of the heat released by these products. By the adjective "reversible" is meant that the stored products may be taken out from storage.

The expression "very long-term" means at least fifty years and, preferably, several periods of fifty years.

One privileged application of the installation of the invention concerns the storage of nuclear waste having very high long-term activity, such as irradiated fuel in nuclear reactors.

PRIOR ART

The storage of hazardous calorific products such as nuclear waste is a major problem for which a certain number of solutions have already been put forward.

Among such solutions, reference will only be made to those which ensure passive cooling of the products without the supply of any outside energy. This passive form appears essential to obtain the required reliability throughout the very long period of storage under consideration.

According to one first known storage technique, the products are packaged in containers which are placed in cavities made in the ground, said cavities being delimited by concrete walls. An air-filled space is provided between each container and the cavity walls. Heat evacuation is obtained solely by circulation of air under natural convection.

One notable disadvantage of said type of installation is that cooling is achieved via a primary circuit, in direct contact with the container walls. This type of arrangement is dispersive in the event of an incident and therefore dangerous for the environment. In addition, it only allows very limited evacuation of the heat flow.

According to another known storage technique, the general arrangement is similar to the previous one, but cooling is ensured by secondary cooling circuits through which a fluid passes, water in particular or air under natural convection. These circuits are fully embedded in the concrete walls which delimit the cavities housing the containers.

Such installations have a certain number of disadvantages.

Firstly, since cooling is achieved only inside the concrete walls themselves, the surfaces of these walls delimiting the cavities are heated directly by the stored products. The consequence is weakening of the concrete at least on the surface. Also, the temperature of the containers remains very high, leading to rapid ageing of their welds. Finally, with such storage installations it is not possible to control the outside temperature and therefore the inside temperature of the containers and this may, for example, lead to destruction of the cladding of the irradiated fuel.

A third known storage technique sets itself apart from the previous technique chiefly through the fact that the secondary cooling circuits cross through the walls delimiting the cavities and are partly located in the space surrounding the containers.

In this case, almost the same disadvantages are found as with the previous known technique. Also, since the cooling circuit passes locally through the surfaces of the concrete walls delimiting the cavities, these surfaces are subjected to non-homogeneous heat stresses which lead to accelerated ageing of the concrete.

With a fourth known storage technique, the space provided between each container and the cavity in which it is housed is filled with water and the cooling circuit is fully located in this space.

This known solution is characterized by corrosion problems due to the fact that the containers are immersed in water. Also, any leak from the cooling circuit entails a contamination risk if the stored products are nuclear waste. Further, the maintenance of this type of storage device is particularly heavy.

From document DD-A-223 562 an installation is known for the storage of irradiated nuclear fuel in which cylindrical containers containing the products are placed one on top of the other in wells delimited by concrete walls. The wall of each well is lined on the inside with a metal tube which projects above the well as far as a heat dissipater, with vanes or similar, able to transmit the heat it receives to the surrounding atmosphere. A plug is placed at the top of the well inside the metal tube above the containers.

The efficacy of said device is relatively limited and does not prevent major heating of the containers and well walls. Also, a substantial heat gradient exists between the containers placed at the bottom of the well and the containers nearer to the surface. Consequently, surface weakening of the concrete and accelerated ageing of the container welds and dissipater tube (which is not interchangeable) are practically unavoidable.

Also, document U.S. Pat. No. 4,040,480 describes a storage installation for radioactive products in which the products are packaged in cylindrical containers and placed in a ring-shaped cavity delimited between the concrete wall of a well having a circular cross-section and a closed vertical tube, forming a coolant duct, positioned in the well axis. At its top part, positioned above a plug sealing the well, the vertical tube carries cooling vanes in contact with the air.

The heat diffused by the stored products propagates both towards the well wall and towards the tube forming the coolant duct. Relatively rapid damage to the concrete surface is therefore predictable. Also, no provision is made in the event of failure of the coolant duct.

As a general rule, the installations known to date are designed for a maximum lifetime of approximately fifty years, whereas the need exists in the nuclear industry for storage over several fifty-year periods, typically up to 300 years.

Document JP-A-05 273393 suggests packaging spent fuel assemblies separately in casings and placing each of the casings in a closed container hung from a slab of a building. The lower part of each container is housed in an individual well and the top part is positioned in a common corridor swept by a stream of coolant air.

Finally, document FR-A-2 160 concerns a transport tower for radioactive products surrounded by a jacket fitted with cooling vanes, the jacket being assembled such that it can be dismounted.

DISCLOSURE OF THE INVENTION

The subject of the present invention is precisely a storage installation for calorific products, such as nuclear waste, which does not have the disadvantages of installations of the prior art. In other words, the subject of the invention is a passive storage installation able to evacuate a great quantity of heat over a very long period, while offering very high reliability and sturdiness, in particular by only subjecting the materials to demands that are compatible with a very long lifetime.

In accordance with the invention, this result is obtained by means of a very long-term storage installation for calorific products, comprising at least one sealed cavity, at least one confinement container for said products, able to be housed in the cavity, and means forming a thermosiphon able to dissipate the heat released by said products above the cavity, characterized in that the thermosiphon-forming means are partly integrated in a jacket in direct contact with the container which it surrounds.

The use of means forming a thermosiphon integrated into a jacket closely surrounding the container makes it possible to provide efficient evacuation of the heat released by the products contained in the container, without however risking any dispersion of contamination in the event of an accident. Also, the jacket forms a heat shield between the container and the wall of the cavity. The latter, generally made in concrete if the stored products are nuclear waste, is therefore cooled efficiently and in homogeneous manner in the same way as the actual container. Accelerated ageing of the concrete, container welds and container contents is therefore avoided. In addition, it is possible to have knowledge of and efficiently adjust the surface temperature of the container and the temperature of the wall of the well or trench. This also makes it possible to pilot the conditions of storage in accordance with usual hypotheses (not generally heeded in existing installations) according to which the temperature of the concrete surface is known and fixed. Such installation also has the advantage of allowing the cold source, positioned above the cavity, to be adapted to changes over time in the heat released by the stored products.

In one preferred embodiment of the invention, the jacket can be dismounted. Also, the cavity is advantageously sealed by a removable plug above the container. With this arrangement it is possible, if necessary, to replace the jacket integrating the thermosiphon or to remove the container should any problems arise.

In this case, the jacket is advantageously open and made in a flexible, elastic material such as metal so that it can occupy a natural state in which it is spaced away from the container. In this natural state the jacket can be easily mounted and dismounted. In this case, releasable clamp means are provided, to apply the jacket tightly around the container at the time of placing in storage.

Preferably, the jacket is then in the shape of a cylinder open along a generating line and the releasable clamp means are positioned between the edges vis-a-vis this generating line.

In order to avoid excessive heating of the cavity walls, a space generally filled with air is advantageously provided inside the cavity around the container fitted with its jacket, and the air may or may not be circulated by natural convection.

In the preferred embodiment of the invention, the jacket comprises a plurality of outer tubes filled with coolant fluid whose lower and upper ends respectively lead to a lower ring collector and an upper ring collector.

In this case, cooling vanes are preferably formed on at least some of the outer tubes, such as to increase heat exchange with the air contained in the cavity.

In this preferred embodiment of the invention, the outer tubes may be welded to the jacket.

As a variant, the jacket may also comprise a plurality of segments, fixed end to end by assembly means such as welds or rivets. Each of the outer tubes is then made in one piece with one of these segments.

In order to ensure cooling of the fluid (generally water) contained in the thermosiphon-forming means, the latter also comprise heat exchange means placed above the cavity and forming a cold source.

If the jacket can be dismounted, the heat exchange means are connected to the jacket by connection means which can be disconnected.

Advantageously, the heat exchange means are adapted to variations in the flow of heat to be dissipated.

In the preferred embodiment of the invention, the thermosiphon-forming means form a coolant duct.

Advantageously, the installation of the invention is applied to the storage of nuclear waste. In this case, the cavity is delimited by concrete walls.

BRIEF DESCRIPTION OF THE FIGURES

Using non-restrictive examples the different embodiments of the invention are described below with reference to the appended drawings, in which.

DETAILED DESCRIPTION OF SEVERAL EMBODIMENTS OF THE INVENTION

Figure 1:
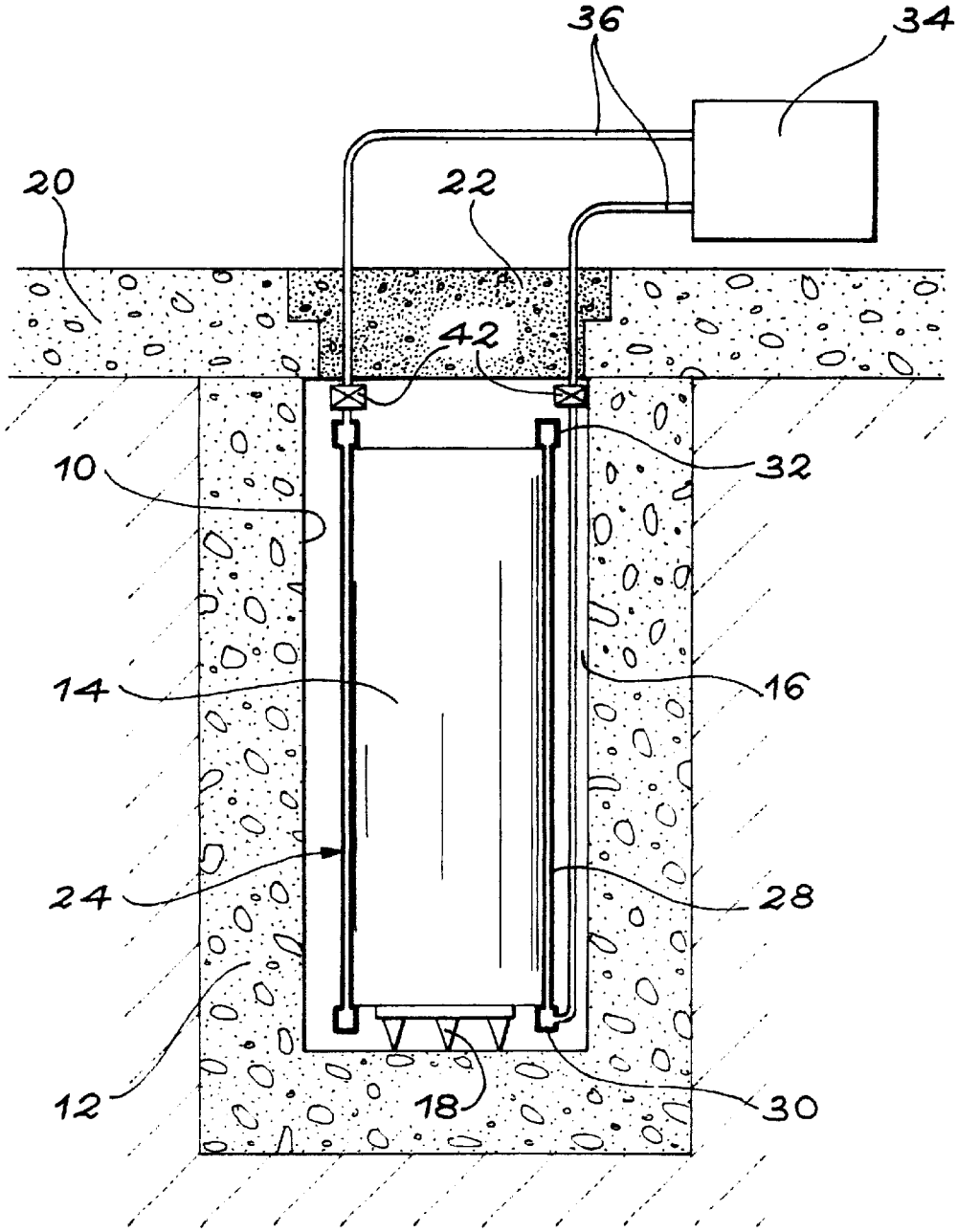
FIG. 1 is a vertical section view giving a very schematic diagram of a storage installation for calorific products according to the invention.

FIG. 1 is a very schematic diagram of part of a very long-term storage installation for calorific products, such as nuclear waste, built in accordance with the invention.

The installation comprises at least one sealed cavity 10, such as an embedded trench, whose sides and bottom are delimited by concrete walls 12.

In the described embodiment, cavity 10 is in the form of a rectilinear embedded trench. This trench is able to house several containers 14 in which the products to be stored are packaged. However, the shape of cavity 10 may be different while remaining within the scope of the invention. Therefore, it is possible for each of containers 14 to be placed in a separate, individual cavity.

In similar manner, the containers 14 used to confine the products to be stored are metal containers whose size and shape may vary while remaining within the scope of the invention. In the embodiment illustrated by way of example, the containers 14 are of cylindrical shape and are placed side by side and on one same level in the trench forming cavity 10, their axes being substantially oriented in vertical direction.

More precisely, each of containers 14 is in contact neither with neighbouring containers nor with the walls of cavity 10. In other words, a space 16 filled with air is provided, inside cavity 10, around each of containers 14. Air circulation in this space 16, by natural convection, contributes towards the cooling of containers 14.

To preserve this space below each of containers 14, the latter rest on the bottom of cavity 10 via a pedestal 18. Also positioning or spacing means (not shown) are advantageously provided between cavity 10 and each of containers 14, in order to ensure the positioning and centering of the containers in the cavity.

As illustrated in FIG. 1 also, cavity 10 is sealed at the top by a concrete slab 20. Above each of containers 14, the concrete slab 20 has an opening generally of round shape sealed by a removable plug 22. This removable plug 22 is also made in concrete. Its removal makes it possible to place each of containers 14 in position separately inside cavity 10, and optionally to remove them from this cavity. For this purpose, handling means (not shown) are provided above the concrete slab 20. This arrangement ensures biological protection when the stored products are nuclear waste products, and mechanical protection against falling aircraft or acts of malevolence.

Figure 2:
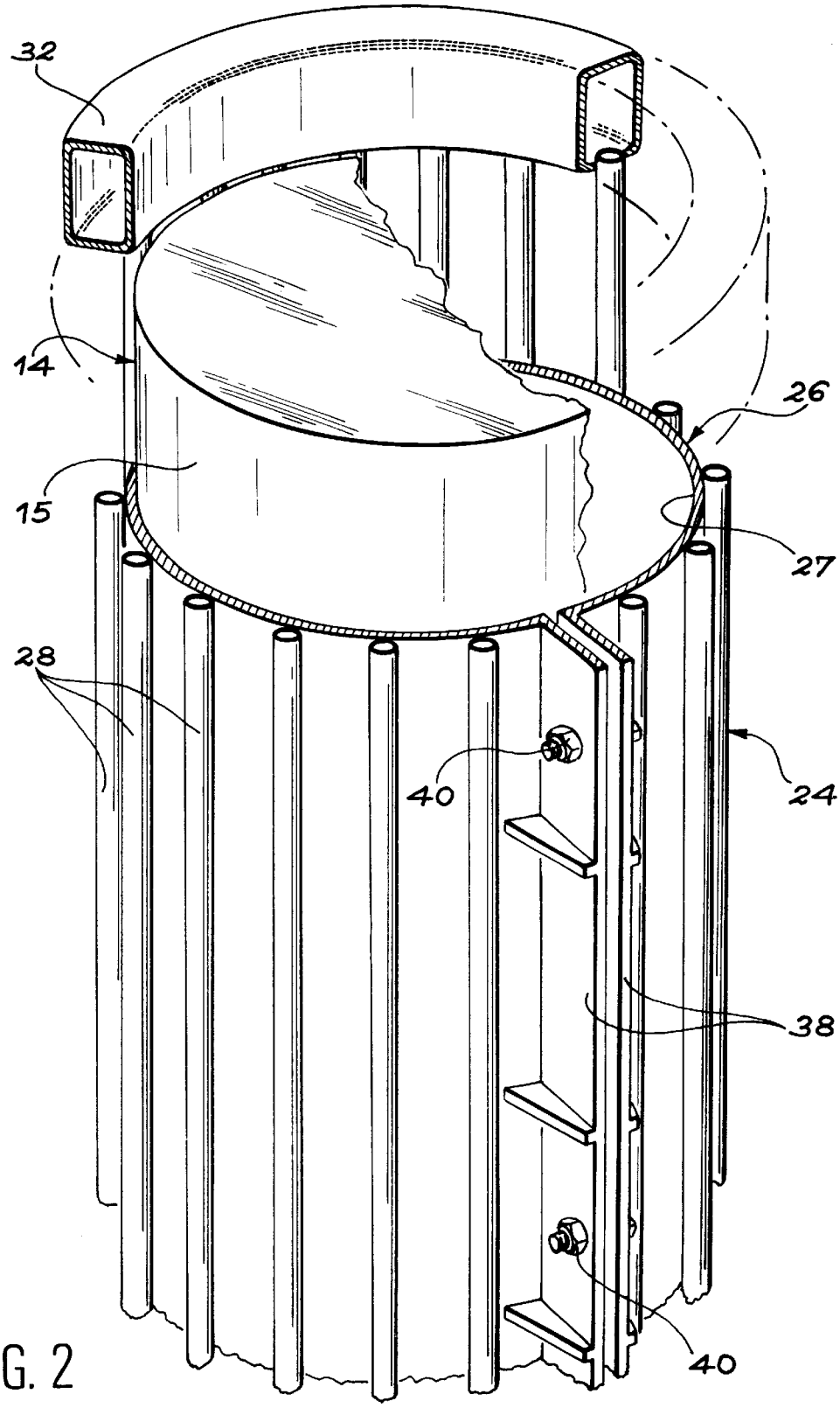
FIG. 2 is a perspective, partial cut-away section view showing the upper part of the jacket which tightly surrounds each container in the installation of FIG. 1.

To evacuate the heat released by the products stored inside a container (which may represent an energy of 80 kW) into atmospheric air, the installation of the invention also comprises means 24 forming a thermosiphon (FIG. 2). More precisely, part of these thermosiphon-forming means are integrated in a jacket 26 which surrounds each of containers 14 such that its smooth inner cylindrical surface 27 is normally in close contact with the smooth outer cylindrical surface 15 of the container. In addition, the jacket 26 is made in a heat conductive material, a metal for example such as stainless steel or copper.

With this arrangement, the heat released by the products contained in containers 14 is transmitted by the thermosiphon-forming means 24 in efficient and homogeneous manner over the entire periphery of these containers. Heat contact between the container and the jacket is ensured by the direct contact between the two walls. Heat resistance is reduced since the effective thickness of the film of residual air between the walls is limited to a fraction of a millimetre.

In the embodiment illustrated in the figures, the part of the thermosiphon-forming means integrated into jacket 26 is in the form of a sealed cooling circuit surrounding container 14. This circuit comprises a plurality of outer tubes 28, fixed to the outer surface of the jacket 26 along its generating lines, and a lower ring collector 30 and an upper ring collector 32, to which the lower and upper ends of the tubes 28 respectively lead. Tubes 28 are numerous and evenly distributed around the entire circumference of jacket 26. A coolant fluid, such as water at 100 C, is placed inside the circuit. When in operation, the water is in the liquid state in the lower ring collector 30 and in the vapour state in the upper ring collector 32. The thermosiphon-forming means 24 therefore form a coolant duct which tightly surrounds the container and homogenizes the temperature thereby preventing the formation of hot points.

In other words, the thermosiphon-forming means 24 use the principle of the evaporation/condensation cycle of a coolant fluid to transfer heat from a hot source, formed by container 14, towards a cold source placed above slab 20. They are sealed, passive means since they only act by change in fluid phase.

As schematically shown in FIG. 1, the cold source of the thermosiphon-forming means 24 comprises heat exchange means 34 such as an air condenser positioned outside and above cavity 10, that is to say above the concrete slab 20. These heat exchange means 34 are connected by two pipes 36 to collectors 30 and 32 of the cooling circuit associated with jacket 26. More precisely, in the embodiment described by way of example, one same heat exchange means 34 is connected to each of the cooling circuits carried by jackets 26 surrounding all the containers 14 placed in one same cavity 10.

The heat exchange means 34 may be of any shape appropriate for their function and still remain within the scope of the invention. It is to be noted that they may be implanted at a certain height above the concrete slab. 20 and at a certain distance from the containers with no notable deterioration in the performance of the installation.

The pipes 36 which connect the heat exchange means 34 to the lower 30 and upper 32 ring collectors of one or more cooling circuits associated with jackets 26 cross through passageways provided for this purpose in the removable plugs 22.

In the preferred embodiments of the invention illustrated in the figures, the jackets 26 are mounted on the containers such that they may be dismounted separately from the latter. It is therefore possible, after removing any one of the removable plugs 22, to replace the jacket 26 of the corresponding container 14 without it being necessary to remove the container from cavity 10. The sizes of the opening made in the slab 20 above each of containers 14 is adapted to allow such replacement.

This arrangement greatly facilitates the very long term management of the storage installation. It allows easy servicing of any faulty part of this installation using remote handling means placed over slab 20, guaranteeing the very long-term evacuation of the heat dissipated by the products stored in the containers.

Figure 3:
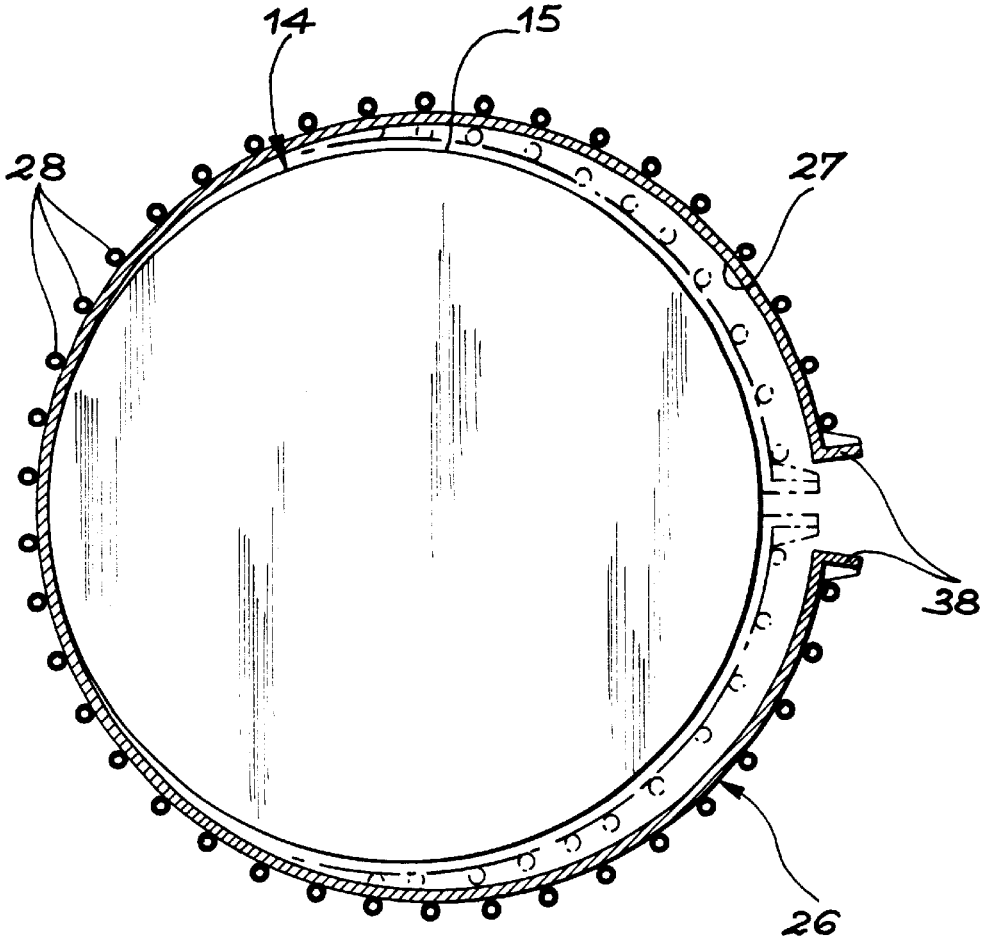
FIG. 3 is a section view along a horizontal plane showing the jacket as a solid line in its natural open state and as a dashed line when it tightly surrounds the container.

In practice, and as illustrated in particular by FIGS. 2 and 3, the possible dismounting of jackets 26 is achieved by making each one in the form of a cylinder open along a generating line. In addition, the jackets 26 are made of flexible, elastic material having very low overall stiffness such as a metal sheet of narrow thickness (3 to 4 mm for example).

In its natural state at rest, and as shown by the solid line in FIG. 3, the diameter of the smooth inner cylinder surface 27 of jacket 26 is much greater than the diameter of the smooth outer cylinder surface 15 of container 14. Therefore, there is a gap between jacket 26 and container 14 when the jacket is in its natural state at rest. It can consequently be easily dismounted or positioned around a container 14 placed in cavity 10 through a movement made parallel to the vertical axis of the container.

As shown in FIG. 2 in particular, each of the edges opposite the open generating line of jacket 26 comprises a clamp plate 38 radially oriented outwards so that the two plates 38 are substantially parallel to one another. The plates 38 of one same jacket 26 have holes at regular intervals in which bolts 40 can be mounted forming releasable clamp means, able to apply jacket 26 tight against container 14.

The bolts 40 which here form the releasable clamp means may be replaced by any other means able to bring together plates 38 in order to apply the smooth inner cylindrical surface 27 of jacket 26 against the smooth outer cylindrical surface 15 of container 14 by tautening the jacket. This result may be obtained without any excessive effort on account of the weak stiffness of the material in which jacket 26 is made.

It is to be noted that the releasable clamp means are preferably chosen so that they can be easily placed in position and actuated by remote handling means from the space located above slab 20 after removing plug 22 or a shutter provided in the latter.

The heat exchange means 34 are advantageously arranged so that they can be adapted to changes over time in the flow of heat released by the products stored in the containers. However, any servicing of jackets 26 must be feasible even though said heat exchange means 34 are in position. Therefore, the positioning of these heat exchange means 34 above the concrete slab 20 must be made so that replacement of jackets 26 is possible and so that containers 14 can be put in place and optionally removed.

As also illustrated in FIG. 1, the arrangement just described leads to making provision for connection means 42, which can be disconnected, on each of pipes 36. These disconnectable connection means 42 are advantageously positioned under slab 20. They are accessible, as are the releasable clamp means, via access points provided in the removable plugs 22. Within the scope of the invention, the disconnectable connection means 42 may be in any form.

According to a first embodiment of the invention, illustrated in FIGS. 2 and 3, the jacket 26 is made in a relatively thin, flexible metal sheet, and tubes 28 are directly welded to the outer surface of this sheet.

Figure 4:
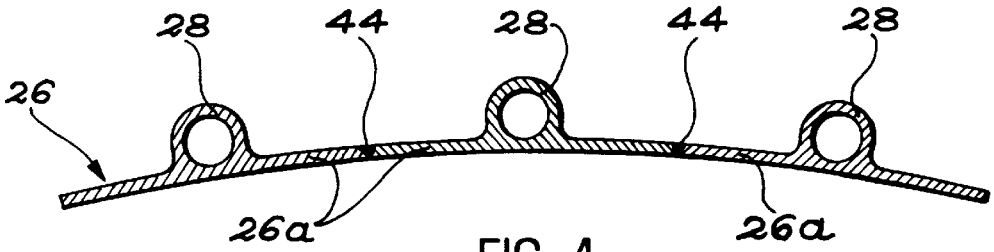
FIG. 4 is a section view along a horizontal plane illustrating another embodiment of the jacket on a larger scale.

Under another embodiment of the invention, schematically shown in FIG. 4, jacket 26 is formed of a plurality of segments 26*a*, placed circumferentially end to end. Each of segments 26*a* is fixed to the adjacent segment by assembly means formed in this case by welds 44.

In this embodiment shown in FIG. 4, each of the outer tubes 28 is made in one single piece with a corresponding segment 26*a* of jacket 26.

Figure 5:
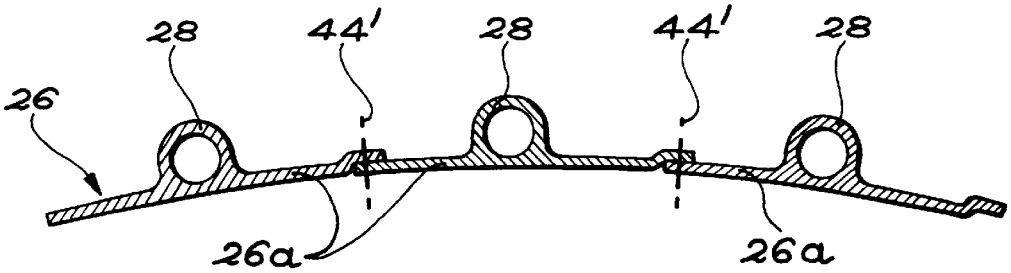
FIGS. 5 and 6 are section views comparable with FIG. 4, illustrating variants of embodiment of the invention.

FIG. 5 illustrates a variant of the embodiment in FIG. 4, which differs essentially in the assembly means joining the different segments 26*a* end to end forming jacket 26. In this case, instead of being joined by welds 44, segments 26*a* have superimposed adjacent edges through which the fixing parts are passed such as rivets as shown by the dashed lines 44' in FIG. 5.

Figure 6:
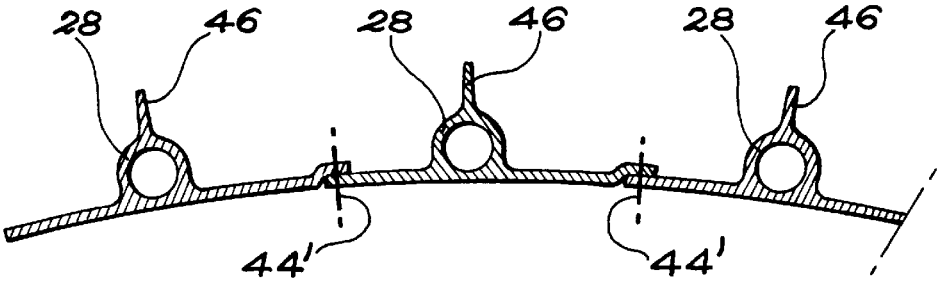

FIG. 6 illustrates another variant of the jacket 26. It is to be noted that this variant can be applied indifferently to the embodiments which have just been described with reference to FIGS. 2, 4 and 5 successively, even though FIG. 6 only illustrates the case in FIG. 5.

As illustrated in FIG. 6, each of outer tubes 28 is, in this case, provided with at least one cooling vane 46. This vane 46, placed in the space 16 arranged in cavity 10 around jacket 26, improves the "vane effect" provided by the actual tubes 28. This "vane effect" enables evacuation of the heat released by the products stored in the containers, in combination with natural air circulation in space 16 surrounding the containers, when this type of cooling becomes sufficient, in the event of a decrease over time in the flow of heat from the stored products. In addition, this "vane effect" facilitates the emergency cooling of the container in the event of failure of the thermosiphon-forming means.

The storage installation just described provides for the storage, confinement and evacuation of the heat dissipated by calorific products over a very long period. The thermosiphon-forming means 24 allow a large quantity of heat to be evacuated, as is required at the start of the storage period of nuclear waste. The proposed arrangement therefore makes it possible to maintain the welds of container 14 and the calorific products at a temperature that is sufficiently low to prevent their accelerated ageing. It also makes possible the application of a homogeneous temperature to the surface of the concrete cavity which is also sufficiently low to prevent its weakening over time.

In addition, the thermosiphon-forming means 24 form a secondary circuit, separated from the products packaged in the container both by its wall and by the walls of tubes 28 carried by jacket 26. This ensures environmental protection in the event of a container leak.

Also, in the preferred embodiments of the invention according to which jacket 26 can be dismounted, it is possible to act quickly and without danger on the thermosiphon-forming means by direct replacement of the faulty jacket.

It is to be noted that the installation may be completed by additional equipment (not shown) with which to collect any possible liquid or gas effluent and to ensure its control before it is discarded so as to protect the environment. Such equipment is conventional and does not call for any particular description.

Evidently the invention is not restricted to the embodiments just described by way of example, but covers all their variants. Hence, if the storage period is not too long, the jackets can be clamped and fixed permanently to the containers. On the contrary, the interchangeability of the jackets may be achieved by making them in the form of semi-shells assembled together in dismountable manner, or semi-shells articulated to one another, or in any other appropriate form providing close contact between the jackets and the containers, able to ensure optimal heat exchange.

In addition, the cooling circuit associated with the jacket may be made differently, for example in the form of spiral-shaped tubes or passage-ways incorporated in thicker areas of the jacket.

What is claimed is:

1. A very long-term storage installation for calorific products, comprising at least one sealed cavity, at least one container to confine said products, said container being housed in said cavity, and thermosiphon-forming means able to dissipate above the cavity the heat released by said products, wherein a jacket surrounds and is in direct contact with the container, said jacket partly integrating the thermosiphon-forming means, wherein a space is provided inside the cavity, around the container fitted with the jacket.

2. The installation according to claim 1, wherein said jacket can be removed from the container.

3. The installation according to claim 2, wherein said jacket is open and made in a flexible, elastic material and occupies a natural state spaced away from the container, wherein releasable clamp means being provided to apply the jacket tightly against the container.

4. The installation according to claim 3, wherein said jacket is in a cylinder form and open along a generating line, and the releasable clamp means are inserted between edges opposite the generating line.

5. The installation according to claim 1, wherein the cavity is sealed by a removable plug above the container.

6. The installation according to claim 1, wherein the jacket comprises a plurality of outer tubes filled with coolant liquid and leading respectively to a lower ring collector and an upper ring collector.

7. The installation according to claim 6, wherein the outer tubes are welded to the jacket.

8. The installation according to claim 2, wherein the thermosiphon-forming means also comprise heat exchange means placed above the cavity.

9. The installation according to claim 8, wherein the heat exchange means are connected to the jacket by disconnectable connection means.

10. The installation according to claim 8, wherein the heat exchange means are adapted to variations in the flow of heat to be dissipated.

11. The installation according to claim 1, wherein the thermosiphon-forming means form a coolant duct.

12. The installation according to claim 1, applied to storage of nuclear waste, wherein the cavity is delimited by concrete walls.

13. A very long-term storage installation for calorific products, comprising at least one sealed cavity, at least one container to confine said products, said container being housed in said cavity, and thermosiphon-forming means able to dissipate above the cavity the heat released by said products, wherein a jacket surrounds and is in direct contact with the container, said jacket partly integrating the thermosiphon-forming means, wherein the jacket comprises a plurality of outer tubes filled with coolant liquid and leading respectively to a lower ring collector and an upper ring collector, wherein the cooling vanes are formed on at least some of the outer tubes.

14. A very long-term storage installation for calorific products, comprising at least one sealed cavity, at least one container to confine said products, said container being housed in said cavity, and thermosiphon-forming means able to dissipate above the cavity the heat released by said products, wherein a jacket surrounds and is in direct contact with the container, said jacket partly integrating the thermosiphon-forming means, wherein the jacket comprises a plurality of outer tubes filled with coolant liquid and leading respectively to a lower ring collector and an upper ring collector, wherein the jacket comprises a plurality of segments fixed end to end by assembly means, each of the outer tubes being made in a single piece with one of said segments.

* * * * *